US007387293B2

(12) United States Patent
Boucher

(10) Patent No.: US 7,387,293 B2
(45) Date of Patent: Jun. 17, 2008

(54) DEVICE FOR HOLDING AND POSITIONING CONSTRUCTION MATERIALS

(75) Inventor: Lawrence Boucher, Beauce (CA)

(73) Assignee: Lawrence Boucher Construction Inc., Quebec (CA)

( * ) Notice: Subject to any disclaimer, the term of this patent is extended or adjusted under 35 U.S.C. 154(b) by 273 days.

(21) Appl. No.: 11/019,919

(22) Filed: Dec. 22, 2004

(65) Prior Publication Data

US 2006/0137290 A1 Jun. 29, 2006

(51) Int. Cl.

| | |
|---|---|
| ***E04G 21/04*** | (2006.01) |
| ***E04G 21/14*** | (2006.01) |
| ***E02D 35/00*** | (2006.01) |
| ***E04B 2/82*** | (2006.01) |
| ***E04B 1/38*** | (2006.01) |
| ***E04B 1/61*** | (2006.01) |
| ***B66F 3/00*** | (2006.01) |
| ***B60P 1/48*** | (2006.01) |

(52) U.S. Cl. ..... 254/131; 254/120; 254/8 R; 414/11; 52/127.2; 52/122.1; 52/126.1; 52/125.1; 52/127.5; 52/127.6

(58) Field of Classification Search ..... 52/127.2, 52/122.1, 132.1, 125.1, 125.3, 126.1, 127.5, 52/127.6; 414/10, 11; 248/351, 354.1; 254/120, 254/8 R, 905, 131

See application file for complete search history.

(56) References Cited

U.S. PATENT DOCUMENTS

| | | | | |
|---|---|---|---|---|
| 1,582,147 | A | | 4/1926 | Stanley |
| 1,606,101 | A | | 11/1926 | Russel |
| 1,725,329 | A | | 8/1929 | Blandford |
| 2,337,796 | A | | 12/1943 | Baker et al. |
| 2,465,206 | A | | 3/1949 | Davis |
| 2,692,753 | A | * | 10/1954 | Masterson, Jr. et al. ..... 254/131 |
| 2,719,060 | A | | 9/1955 | Taylor |
| 2,815,132 | A | | 12/1957 | Stone |
| 2,883,073 | A | | 4/1959 | Morris |
| 2,899,084 | A | | 8/1959 | Brunnemer et al. |
| 2,939,590 | A | | 6/1960 | Henry |
| 2,964,293 | A | | 12/1960 | Foth |
| 2,969,220 | A | | 1/1961 | Spencer |
| 2,989,286 | A | * | 6/1961 | Gillespie ..... 254/120 |
| 3,019,914 | A | | 2/1962 | Taylor |

(Continued)

FOREIGN PATENT DOCUMENTS

| | | |
|---|---|---|
| CA | 2 201 008 | 11/1997 |

(Continued)

*Primary Examiner*—Robert Canfield
*Assistant Examiner*—Hunter M Dreidame
(74) *Attorney, Agent, or Firm*—Mathews, Shepherd, McKay & Bruneau, P.A.

(57) ABSTRACT

The present invention discloses a device and method that allows the installation of construction materials, such as drywall, by a single person. The device comprises an extension (or hoist) section coupled at one end to a support which can receive and support a piece of drywall during installation. The extension section is further coupled to a base portion at the end opposite to the support. The base portion includes a pivot feature that serves to lift the drywall once it has been positioned on the support. The extension is adjustable to install drywall on a stud wall at various heights. Advantageously, the device is lightweight, easily transportable and easy to use. The device's convenient design enables its utilization immediately upon reaching a construction site.

3 Claims, 5 Drawing Sheets

U.S. PATENT DOCUMENTS 3,028,978 A 4/1962 Dickens
3,049,243 A 8/1962 Buice
3,058,602 A 10/1962 Kilman
3,157,411 A * 11/1964 Rhodes ..... 280/47.29
3,178,038 A 4/1965 Love
3,221,900 A 12/1965 Love
3,268,209 A 8/1966 Humbyrd
3,305,219 A 2/1967 Rhodes
3,314,553 A 4/1967 Vircks
3,317,059 A 5/1967 Higgins
3,318,465 A * 5/1967 Fisher ..... 414/11
3,365,080 A 1/1968 Crull
3,382,988 A 5/1968 O'Reilly
3,467,261 A 9/1969 Jewell
3,822,023 A 7/1974 Cordel
3,828,942 A 8/1974 Young
3,871,054 A * 3/1975 Schaefer ..... 29/267
3,930,645 A 1/1976 Anderson
3,967,738 A 7/1976 Winings
4,027,802 A 6/1977 Reynolds
4,064,999 A 12/1977 Young
4,117,939 A 10/1978 Haddock
4,120,484 A 10/1978 Zimmer
4,150,755 A 4/1979 Trott et al.
4,300,751 A 11/1981 Delaney
4,339,219 A 7/1982 Lay
4,340,205 A 7/1982 Leezer
4,375,934 A 3/1983 Elliott
4,482,130 A 11/1984 Paredes
4,560,031 A 12/1985 Dixon et al.
4,600,348 A 7/1986 Pettit
4,695,028 A 9/1987 Hunter
4,712,771 A * 12/1987 Donnelly et al. ..... 254/131
4,715,760 A 12/1987 Browning
4,733,844 A 3/1988 Molloy
4,868,943 A 9/1989 Robichaud
4,928,916 A 5/1990 Molloy
5,129,774 A 7/1992 Balseiro et al.
5,322,403 A 6/1994 Herde
5,501,561 A * 3/1996 Wulff ..... 414/11
5,640,826 A 6/1997 Hurilla, Jr.
5,700,123 A 12/1997 Rokosh et al.
5,814,842 A * 9/1998 Muldoon et al. ..... 254/131
5,944,468 A 8/1999 McBrien
5,979,854 A 11/1999 Lundgren et al.
6,010,299 A 1/2000 Jesswein
6,082,945 A 7/2000 Jeffries et al.
6,155,764 A 12/2000 Russo
6,176,063 B1 1/2001 Warin
6,244,810 B1 6/2001 Reyes
6,264,423 B1 7/2001 Andresen
6,273,662 B1 8/2001 Fleckenstein
6,302,378 B1 * 10/2001 Koch et al. ..... 254/131
6,497,399 B1 * 12/2002 Nelson ..... 254/131
6,508,448 B1 1/2003 Stewart
6,527,492 B1 3/2003 Kerns, III et al.
6,663,084 B1 12/2003 Butler
7,014,413 B2 * 3/2006 Young ..... 414/743
2001/0029715 A1 * 10/2001 Bradley et al.

FOREIGN PATENT DOCUMENTS

DE 28 01 955 7/1979
DE 296 04 612 8/1996
DE 299 17 616 2/2000
DE 203 08 211 10/2003
EP 0 591 629 4/1994
EP 0 613 986 9/1994
EP 0 716 041 6/1996
EP 0 969 165 1/2000
EP 1 302 607 4/2003
FR 2 538 437 A1 6/1984
FR 2 584 121 A1 1/1987
GB 2 162 815 2/1986
GB 2 260 559 4/1993
GB 2 345 081 6/2000
JP 5 319 770 12/1993
JP 9 328 895 12/1997
WO WO 91/11572 8/1991
WO WO 92/06257 4/1992
WO WO 9309313 A1 * 5/1993
WO WO 96/01353 1/1996

* cited by examiner

DEVICE FOR HOLDING AND POSITIONING CONSTRUCTION MATERIALS

TECHNICAL FIELD

The present invention relates to a device for holding and positioning construction materials. More specifically, the present invention relates to a device that is suitable for holding and positioning construction materials, such as drywall.

BACKGROUND OF THE INVENTION

Drywall (also commonly referred to as or wallboard or sheetrock) is commonly installed on studs to form the basis for finished interior walls of residential and commercial buildings. While drywall is produced in many sizes, the typical sizes for installation are in sheets four feet wide and eight or twelve feet in length.

Standard pieces or sheets of drywall are heavy and difficult to install by one person alone. Accordingly, at least two people are commonly needed to hold and install these drywall sheets. In construction, time is of the essence as it relates to profitability. Use of multiple people reduces efficiency and, therefore, adds to the cost of construction.

A particular problem associated with drywall or wallboard installation relates to hanging the drywall on upper portions of a stud wall. It is particularly difficult to hold drywall at elevated positions on the stud wall for installation. It is also difficult to hold the drywall so that it remains properly aligned with the stud wall, the ceiling, etc. before being secured in place.

A variety of installation devices exhibiting different levels of complexity are known in the art. For example, the following patents and patent applications describe lifters that generally resemble the letter "T", with the drywall or other construction material placed at the top and hoisted into position either through a cranking mechanism, screwing device, spring or telescopic means that are arranged on the vertical portion of the device: U.S. Pat. No. 3,930,645 (Anderson); U.S. Pat. No. 4,120,484 (Zimmer); U.S. Pat. No. 4,695,028 (Hunter); U.S. Pat. No. 4,733,844 (Molloy); U.S. Pat. No. 4,928,916 (Molloy); U.S. Pat. No. 5,129,774 (Balseiro et al); U.S. Pat. No. 5,979,854 (Lundgren et al); U.S. Pat. No. 6,082,945 (Jeffries et al); U.S. Pat. No. 6,508,448 (Stewart); U.S. Pat. No. 6,663,084 (Butler); International Patent Application No. PCT/AU95/00382 (WO 96/01353); and UK Patent Application GB 2,260,559. These devices, while useful for their intended purpose, can be bulky and in many cases do not lend themselves to use by a single person.

The following patents describe lifting or positioning devices that rely on the use of a foot to hoist construction materials a few inches from ground level: U.S. Pat. No. 2,692,753 (Masterson); U.S. Pat. No. 2,989,286 (Gillespie); U.S. Pat. No. 3,268,209 (Humbyrd); U.S. Pat. No. 4,712,771 (Donnelly et al); U.S. Pat. No. 5,501,561 (Wulff); U.S. Pat. No. 5,814,842 (Muldoon et al); and U.S. Pat. No. 6,497,399 (Nelson). While suitable for certain types of construction projects, these devices do not permit materials to be positioned at the higher reaches of a wall.

Some of the more complicated devices for lifting drywall and other construction materials are represented by the following patents: U.S. Pat. No. 3,828,942 (Young); U.S. Pat. No. 4,339,219 (Lay); U.S. Pat. No. 4,375,934 (Elliott); U.S. Pat. No. 4,600,348 (Pettit); U.S. Pat. No. 5,640,826 (Hurilla); U.S. Pat. No. 6,010,299 (Jesswein); U.S. Pat. No. 6,176,063 (Warin); U.S. Pat. No. 6,244,810 (Reyes); and U.S. Pat. No. 6,527,492 (Kerns, III et al). In many cases, these devices require assembly before use. In addition, these devices can be bulky and heavy, including such features as tripods and scaffolding. They are consequently better suited for use in commercial construction projects than in home renovations, for example.

An example of a more current lifting device is described in United States Patent Application Publication Number US 2001/0029715 A1 (Bradley et al). This publication describes a drywall installation apparatus that includes a support for holding the drywall to be installed, an extension to adjust the length of the drywall installation apparatus, and a base to which a lifting mechanism may be coupled to raise the drywall installation apparatus holding the drywall into a desired position for installation on a stud wall. The drywall installation apparatus includes an alignment member to assist in orienting the piece of drywall to be installed on the stud wall. This alignment member (or "stud guide") is U-shaped and serves to maintain the drywall installation apparatus in a desired position when a sheet of drywall is being raised or lowered relative to a stud wall. This installation apparatus, while suitable for certain types of walls, such as the stud walls having metal brackets that are favored in many parts of North America, is less convenient for use on other types of wall surfaces.

There is a need, therefore, for a device for holding and positioning construction materials that is simple to use and lightweight, yet sturdy enough to support the weight charge of most construction materials. There is a further need to provide an installation device and method that will allow a single person to hold and install a construction material on a wall, such as drywall, particularly at upper reaches of the wall.

The present invention seeks to meet these needs.

SUMMARY OF THE INVENTION

The present invention relates to an adjustable support device for holding drywall or gypsum wallboard in place as it is being installed at ceiling level. The device includes an extension section comprising an elongate tubular member and a shaft member telescopically disposed in the elongate tubular member. The extension section is coupled at one end to a support which can receive and hold a piece of drywall during installation. The extension section is further coupled to a base portion at the end opposite to the support. The base includes a pivot feature that serves to lift the drywall once it has been positioned on the support. The extension is adjustable to install drywall on a stud wall at various heights.

Advantageously, this device is lightweight, easy to transport and does not require assembly once on site. It may thus be used immediately upon reaching a construction site, saving on construction time and therefore money. The simplicity of the design should appeal not only to experts in the construction field, but also to novices who engage in home renovation and repair, for example.

Moreover, the device is secure and allows a sheet of drywall to be readily installed by a single person.

The device has the following characteristics:

It can stand alone without support;

It is balanced towards the front in order to permit a vertical lift along a wall;

It is suitable for lifting or hoisting a variety of construction materials, including gypsum drywall, rigid insulation panels, decorative wall panels, as well as any other flat material that is to be positioned onto a wall;

It possesses a useful charge of approximately 500 lbs;

It lifts construction materials through the use of single, light foot pressure performed in an effortless manner by the end user;

It adjusts easily to the desired height; and

It is very resistant.

The device may be made of iron, steel or any other metallic alloy that has the capacity to support the weight of construction materials.

BRIEF DESCRIPTION OF THE FIGURES

An embodiment of the invention will now be described by way of example only with reference to the accompanying drawings, in which.

DETAILED DESCRIPTION

Figure 1:
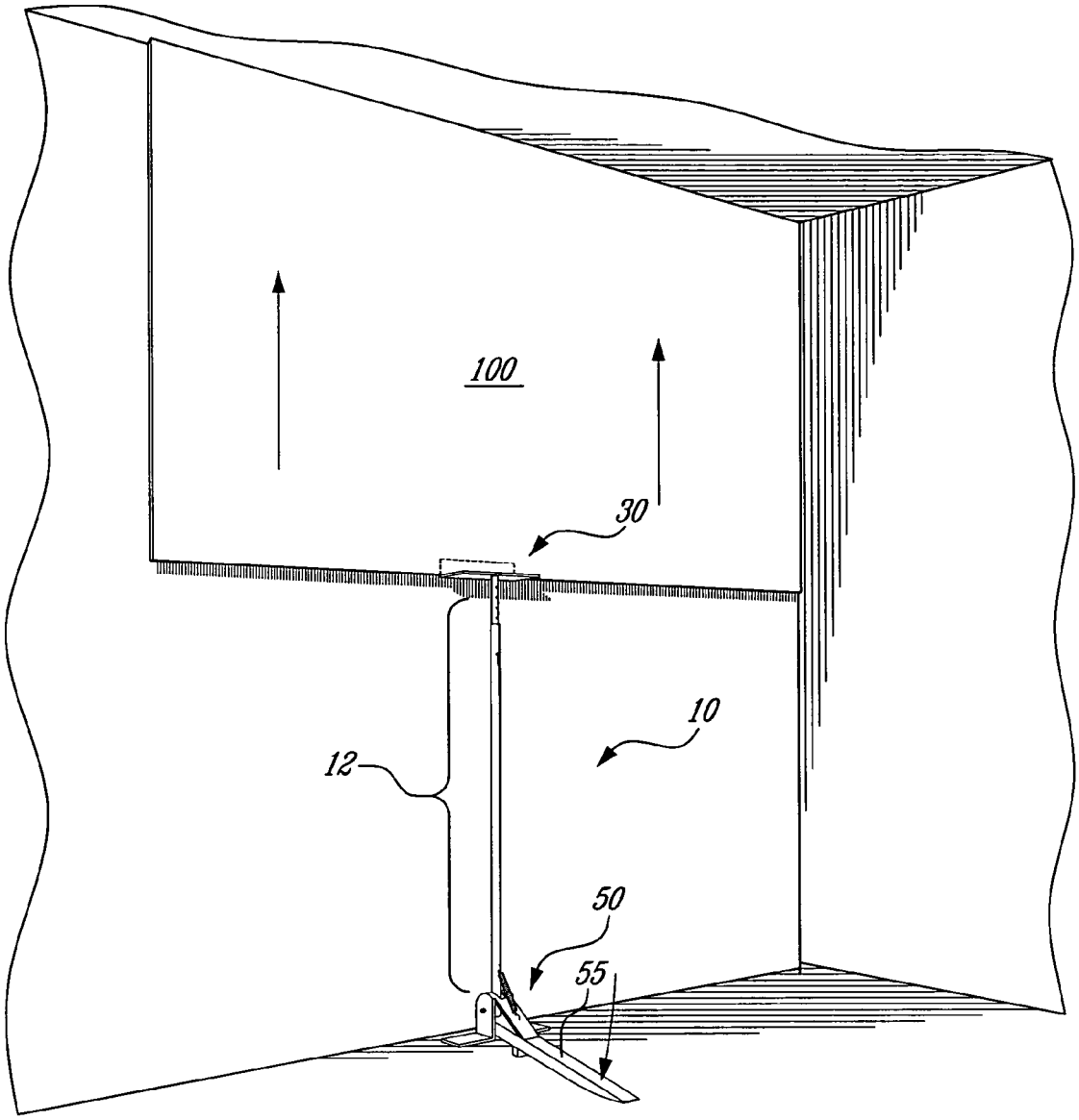
FIG. 1 is a perspective view of the device of the present invention showing it in use, supporting a drywall panel so that it may be attached by nails, screws and the like to a stud wall.

FIG. 1 shows the principal features of a particular embodiment of the device of the present invention. The device 10 includes an adjustable extension section 12 allowing the installation of drywall on a stud wall at various heights. It is coupled at one end to a support 30 which can receive and hold a piece of drywall 100 during installation, as illustrated in FIG. 1. The extension section 12 is further coupled to a base portion 50 at the end opposite to the support. The base portion 50 includes a pivot feature 55 that serves to lift the drywall once it has been positioned on the support.

Figure 2:
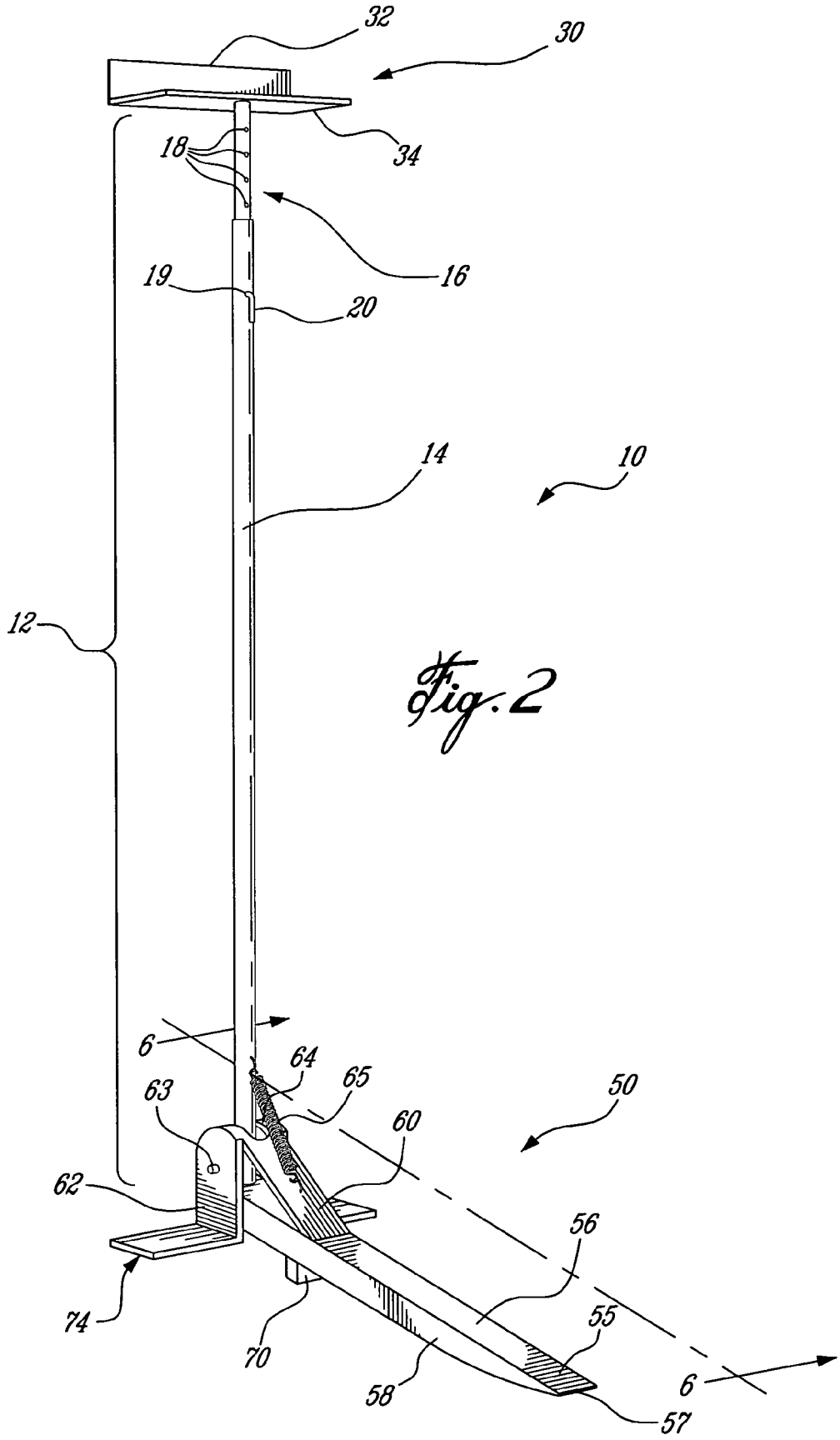
FIG. 2 is another perspective view of the device illustrating its features.

Turning now to FIG. 2, beginning from the top of the device one can see the features of the support 30 in greater detail. The support 30 includes a horizontally projecting support bearing flange 34 and a vertically projecting pusher flange 32 for pushing against the back face of the construction material. As illustrated in FIG. 2, the horizontally projecting support bearing flange 34 is located at an approximately right angle relative to the vertically projecting pusher flange 32. Advantageously, the support bearing flange's flat shape and extended length prevent breakage of the construction material that is to be lifted.

Still in FIG. 2, the extension section 12 comprises an elongate tubular member 14 and a shaft member 16 telescopically disposed in the elongate tubular member 14. The shaft member 16 must be capable of ready movement within the tubular member 14, so that the device may be manually adjusted to the desired height. As illustrated here, the shaft member 16 includes orifices 18 that allow the extension section 12 of the device to be secured at a variety of different heights through the use of a locking mechanism 20 which engages with a chosen orifice 18 when this orifice is aligned with a corresponding orifice 19 (shown in shadow in FIG. 4) in the elongate tubular member 14. The orifices shown here are circular in shape but may assume any convenient geometry for engagement with a chosen locking mechanism: square, hexagonal, octagonal, etc.

As shown at the bottom of FIG. 2, the base portion 50 includes a pivot feature 55 that serves to lift the drywall once it has been placed on the support for positioning against a wall. The design of the base portion 50, while simple, allows for the simultaneous support of the drywall when placed on the device 10 and for an end user to lift the drywall through the use of one foot placed on the pivot feature 55. As may be appreciated from the illustration, the base portion 50 includes a support plaque 74 oriented at an approximate right angle relative to the pivot feature. This support plaque 74 is flat and extends a few inches on either side of the pivot feature 55. Underneath the pivot feature 55 an elevation element 70 is disposed at a distance that is approximately $1/3^{rd}$ the distance from the extension section 12 and approximately $2/3^{rd}$ the distance from the proximal end 57 of the pivot feature 55. The elevation element 70 is shown as a rectangular block but may assume a variety of different configurations. Its purpose is to keep the pivot feature 55 at a slight elevation until the end user is ready to place his or her foot on the pivot feature to lift the drywall to the desired height and position. The pivot feature 55 includes two elongate side members 58 disposed at an approximately right angle relative to an upper member 56 suitable to support the end user's foot when the device is in use. The elongate members 58 have a basic rectangular geometry but are tapered as they reach the proximal end 57 of the pivot feature 55. The pivot feature 55 further includes a curved portion 60 which engages with the extension section 12 of the device and serves to secure in place. As illustrated in the figures, a spring 65 or other retention means may be included on the device so as to join the outer surfaces of the curved portion 60 and the elongate tubular member 14 of the extension section 12, in order to prevent the extension section 12 from rocking about.

Figure 4:
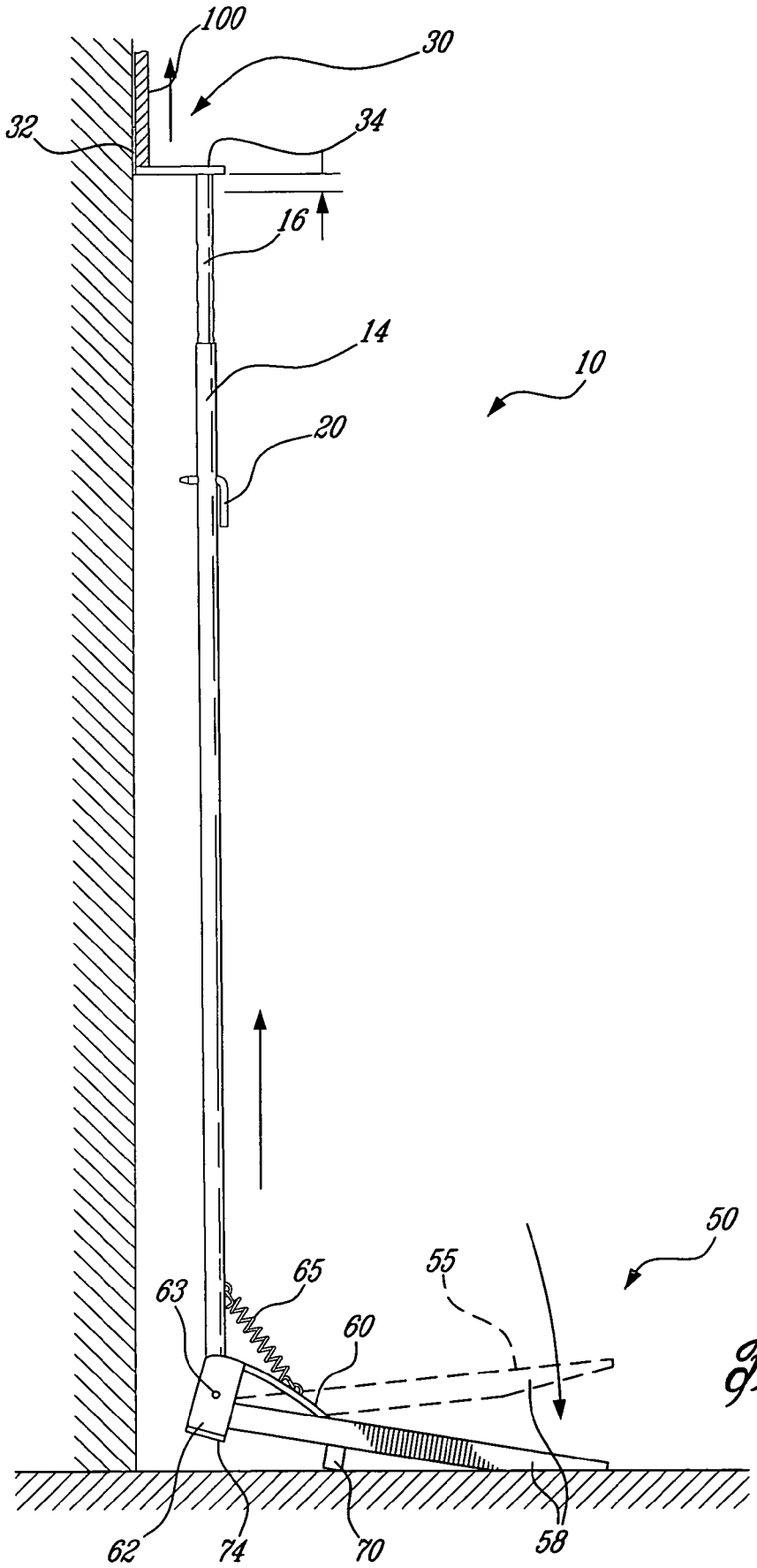
FIG. 4 is a lateral view of the device shown in FIG. 2, illustrating the foot pivot when in use.

As may be seen more particularly in FIG. 4, the extension section 12 has two orifices at its base through which fastening means 63 may be inserted and positioned against side plates 62 located at the distal ends of the two elongate members 58. These fastening means 63 serve to lock the elongate tubular member 14 in place, preventing its lateral motion when the device 10 is in use.

Figure 3:
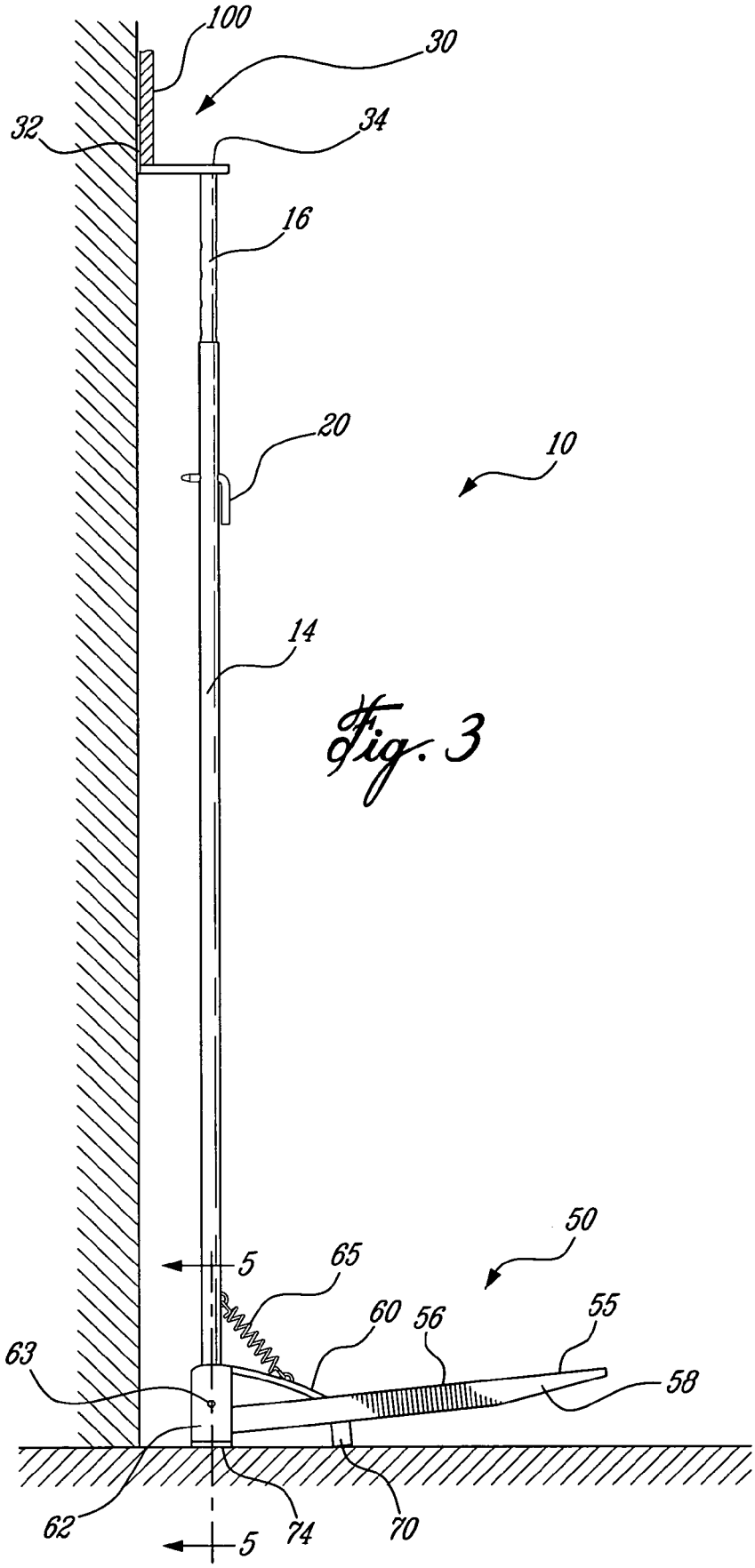
FIG. 3 is a lateral view of the device shown in FIG. 2.

FIGS. 3 and 4 illustrate the device 10 of the present invention from a lateral perspective. FIG. 3 shows the device at rest while FIG. 4 reveals the device when in use.

Figure 5:
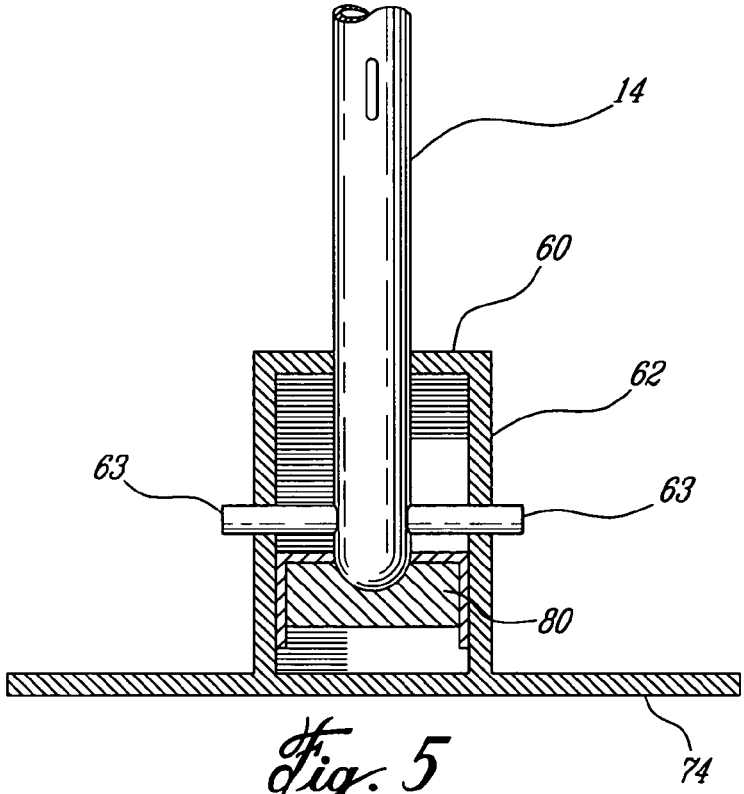
FIG. 5 is a rear sectional view of the pivot or pedal portion of the device taken along line 5-5 of FIG. 3.
Figure 6:
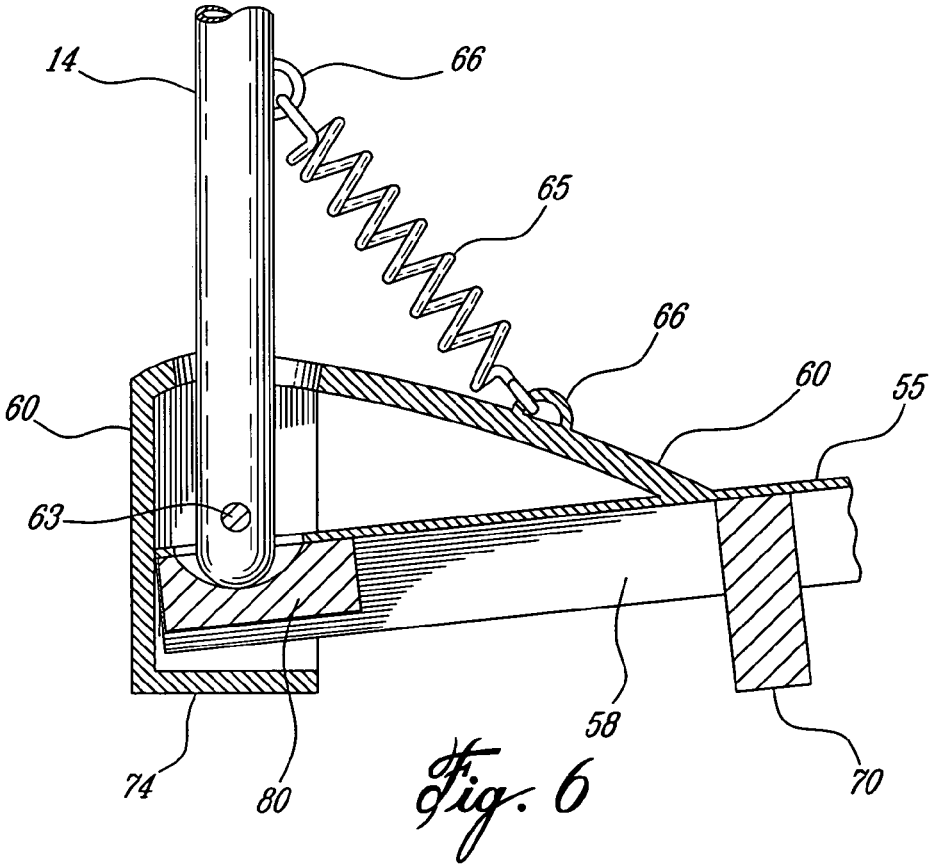
FIG. 6 is a lateral sectional view of the pivot or pedal portion of the device taken along line 6-6 of FIG. 2.

The details of the base portion 50 of the device are illustrated in FIGS. 5 and 6. FIG. 5 is a rear sectional view of the base portion 50 taken along line 5-5 of FIG. 3, while FIG. 6 is a lateral sectional view of the same element taken along line 6-6 of FIG. 2. As may be seen from these figures, the bottom end of the elongate tubular member 14 is curved and rests within a cavity carved in a metal block 80. As better shown in FIG. 6, this cavity is also curved, allowing the elongate tubular member 14 to rock back and forth, but not laterally since the fastening means 63 prevent any sideways motion. In order to restrict this back and forth rocking, a spring 65 or other retention means may be included on the device so as to join the outer surfaces of the curved portion 60 and the elongate tubular member 14 of the extension section 12. As shown in FIG. 6, the ends of the spring may be attached to the curved portion 60 and the elongate tubular member 14 via rings 66, or any other suitable means.

A method for using the device 10 is shown in FIG. 4. To use the device, the end user first adjusts the extension section 12 of the device to the desired height by manually pulling the shaft member 16 within the tubular member 14, and then securing the extension section 12 by inserting a locking mechanism 20 (which can be a pin, screw, or the like) through the orifice 19 in the elongate tubular member 14 which has been aligned with a chosen orifice 18. Next, the user places the construction material on the support 30 of the device, and then positions the device with its load close to where the construction material is to be installed. With the device in position, the end user simply places one foot near the proximal end 57 of the pivot feature 55 of the base portion 50 and pushes downward. This causes the construction material to be elevated approximately 1-3 inches. The device will maintain and support the drywall at the chosen position and height, enabling the end user to attach it to the wall by permanent means.

EXAMPLE 1

Description of the Features of One Particular Embodiment, Including Approximate Dimensions In one particular embodiment, the height of the support in the device can be adjusted from a height of approximately 42" to a height of approximately 60". As will be appreciated by those of skill in the art, the extension section may be manufactured so that it can accommodate a variety of convenient height positions.

The support 30 is made of iron. The horizontally projecting support bearing flange 34 has the following dimensions: 3"×8"×¼". The vertically projecting pusher flange 32 for pushing against the front face of the construction material has the following dimensions: 1"×8"×⅛".

The extension section 12 is made of iron or steel components that are capable of supporting the weight of conventional drywall panels or other construction materials. Any metallic alloy may be selected, as long as it is sturdy enough to support the load of construction materials. The elongate tubular member 14 is 42" in length and has a diameter of ¾". The shaft member 16 telescopically disposed in the elongate tubular member 14 is 32" in length and has a diameter of ⅝". The shaft member 16 includes orifices 18 that are ¼" in size and are spaced apart at a distance of ⅛". The locking mechanism 20 which engages with a chosen orifice 18 when this orifice is aligned with a corresponding orifice 19 is circular, has a length of 1½" and a diameter of ¼".

The base portion 50 includes a support plaque 74 that has the following dimensions: 1"×8"×⅛". Underneath the pivot feature 55, the elevation element 70 is made of iron and has the following dimensions: 2"×2"×¾". The pivot feature 55 itself includes two elongate side members 58 that are approximately 16" in length and ½" in width disposed at an approximately right angle relative to an upper member 56 that is also approximately 16" in length and 2" in width. The elongate side members 58 and the upper member 56 are made of iron and have a thickness of approximately 3/16". Together, the elongate side members 58 and the upper member 56, which comprise the lever portion of the pivot feature 55, create a "U"-type bar. The pivot feature 55 further includes a curved portion 60 which engages with the extension section 12 of the device and serves to secure into place. The curved portion 60 is made of iron and has the following dimensions: 8"×2"×¼". With reference to FIG. 4, it will be recalled that the extension section 12 has two orifices at its base through which fastening means 63 may be inserted and positioned against side plates 62 located at the distal ends of the two elongate members 58. These fastening means 63 are approximately ⅜"×2½", while the side plates have the following dimensions: 2"×3"×¼".

Although the present invention has been described by way of particular embodiments and examples thereof, it should be noted that it will be apparent to persons skilled in the art that modifications may be applied to the present particular embodiment without departing from the scope of the present invention.

What is claimed is:

1. A device for holding and positioning a construction material, comprising:

a support including a horizontally projecting support-bearing flange and a vertically projecting pusher flange (32) for pushing against the construction material, said support being positioned on a top end of an extension section;

wherein said extension section (12) comprises an elongate tubular member (14) and a shaft member (16) telescopically disposed in said tubular member (14);

a base portion (50) including a pivot feature (55) that serves to lift the construction material once it has been placed on said support for positioning against a wall, wherein said base portion (50) comprises a support plaque (74) oriented at an approximate right angle relative to said pivot feature (55), said support plaque (74) being flat and extending on either side of said pivot feature (55);

wherein a bottom end of said tubular member (14) is curved and rests within a curved cavity carved in a metal block (80), wherein said metal block is located within a distal end of said pivot feature (55);

wherein said pivot feature (55) comprises an elevation element (70) that is disposed at a distance that is approximately ⅓rd the length of said pivot feature (55) from said extension section (12) and approximately ⅔rd the length of said pivot feature (55) from a proximal end (57) of said pivot feature (55).

2. The device as defined in claim 1, further comprising retention means between said extension section (12) and said base portion (50) in order to prevent said extension section (12) from rocking about.

3. The device as defined in claim 2, wherein said retention means is a spring.

* * * * *